US007658563B2

(12) United States Patent
Tamehira et al.

(10) Patent No.: US 7,658,563 B2
(45) Date of Patent: Feb. 9, 2010

(54) IMAGE FORMING APPARATUS HAVING UNIT HOUSING PERMITTING MECHANISM

(75) Inventors: Masato Tamehira, Nara (JP); Yoshinori Shiraishi, Nara (JP); Junya Masuda, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 304 days.

(21) Appl. No.: 11/554,636

(22) Filed: Oct. 31, 2006

(65) Prior Publication Data

US 2007/0104530 A1 May 10, 2007

(30) Foreign Application Priority Data

Nov. 7, 2005 (JP) ..... 2005-322594

(51) Int. Cl.
*B41J 29/02* (2006.01)
*B41J 29/12* (2006.01)
*G03G 21/18* (2006.01)

(52) U.S. Cl. ..... 400/692; 400/691; 399/113; 399/124

(58) Field of Classification Search ..... 400/691–692; 399/116, 110–111, 107, 124–126, 113
See application file for complete search history.

(56) References Cited

U.S. PATENT DOCUMENTS 5,189,471 A * 2/1993 Irihara et al. ..... 399/116
5,732,620 A * 3/1998 Christy et al. ..... 100/80
5,797,068 A * 8/1998 Otsuki et al. ..... 399/110
6,941,093 B2 * 9/2005 Park et al. ..... 399/116
7,031,640 B2 * 4/2006 Komoda et al. ..... 399/124
7,418,220 B2 * 8/2008 Shiraishi et al. ..... 399/110
2004/0265031 A1 12/2004 Ueda ..... 400/636
2008/0075503 A1 * 3/2008 Tanaka et al. ..... 399/124

FOREIGN PATENT DOCUMENTS

JP 10-143046 5/1998
JP 11-167331 6/1999
JP 2000-039770 2/2000
JP 2004-013031 1/2004
JP 2004-149301 5/2004
JP 2004-272296 9/2004

OTHER PUBLICATIONS

Japanese Office Action for corresponding Application No. 2005-322594 dated May 19, 2009.

* cited by examiner

*Primary Examiner*—Judy Nguyen
*Assistant Examiner*—Marissa L Ferguson-Samreth
(74) *Attorney, Agent, or Firm*—Renner, Otto, Boisselle & Sklar, LLP

(57) ABSTRACT

An image forming apparatus including: an apparatus body; a first unit which can be pulled/pushed from/to the body along a first direction and which includes at least a part of an image forming section for forming an image and/or of a sheet transporting section for transporting a sheet onto which the formed image is transferred, and; a second unit which can be pulled/pushed from/to the first unit along a second direction in a state where the first unit is pulled from the body, the second direction being different from the first direction; and a housing permitting mechanism for permitting the first unit to be pushed into the body by a predetermined operation, the housing permitting mechanism being provided for at least one of the body and the first unit.

6 Claims, 18 Drawing Sheets

Fig.3

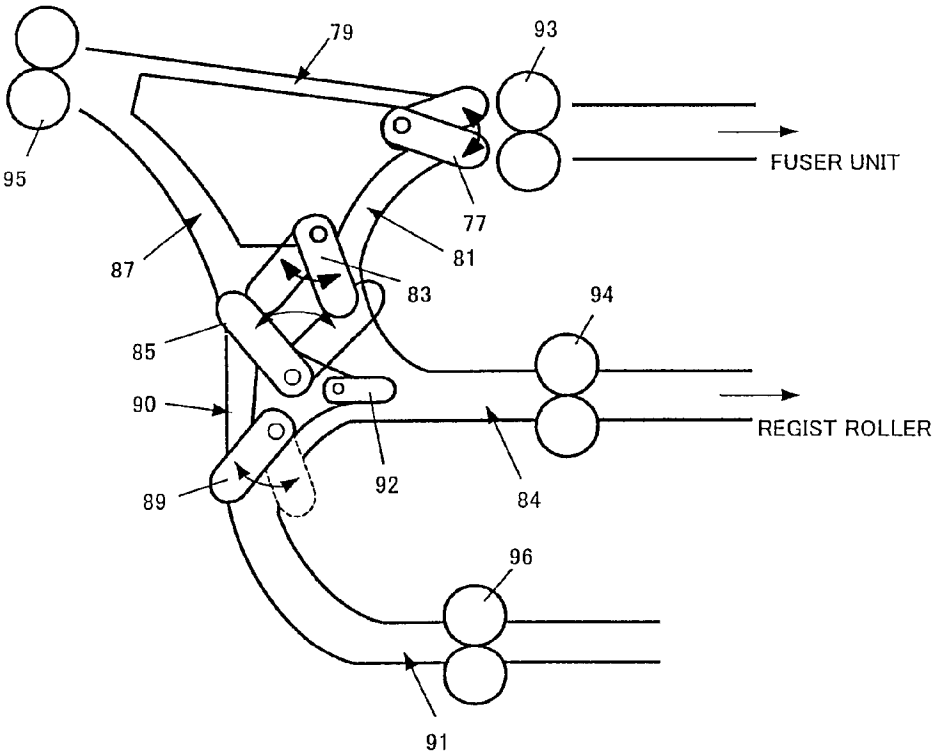

| | The number of claw positions | First claw position | Second claw position | Third claw position | Remarks |
|---|---|---|---|---|---|
| Branch claw A 77 | Two-stage switching | Leading of sheet to transporting path A 79 | Leading of sheet to transporting path B 81 | | Switched by solenoid or the like |
| Branch claw B 83 | Two-stage switching | Leading of sheet to transporting path C 84 | Leading of sheet to transporting path E 90 | | Switched by provided spring and hardness of sheet |
| Branch claw C 85 | Three-stage switching | Leading of sheet to transporting path C 84 | Leading of sheet to transporting path E 90 | Leading of sheet to transporting path D 87 | Switched by solenoid or the like |
| Branch claw D 89 | Two-stage switching | Leading of sheet to transporting path F 91 | Leading of sheet to transporting path C 84 | | Switched by solenoid or the like |
| Branch claw E 92 | Position fixed | | | | |

IMAGE FORMING APPARATUS HAVING UNIT HOUSING PERMITTING MECHANISM

CROSS-REFERENCE TO RELATED APPLICATION

This application is related to Japanese application No. 2005-322594 filed on Nov. 7, 2005 whose priority is claimed under 35 USC §119, the disclosure of which is incorporated by reference in its entirety.

BACKGROUND OF THE INVENTION

1. Field of the Invention

The present invention relates to an image forming apparatus having a unit which can be pulled/pushed from/to the apparatus for allowing a user to access to an image formation section and/or a sheet transporting section in the apparatus and having a mechanism for permitting the unit to be housed.

2. Description of the Related Art

In recent years, an image forming apparatus for performing high-seed printing process has been developed. Although the printing speed of a so-called high speed apparatus (high speed machine) in standard sheet size (a landscape A4 size) was 40 to 60 sheets/minute a few years ago, it is speeded up to 100 to 120 sheets/minute.

When a sheet jam occurs in such an apparatus, a number of sheets being transported are stopped in sheet transporting paths in the apparatus. To restart printing, all of the sheets remaining in the sheet transporting paths have to be removed by a user to open the transporting paths in the apparatus. However, in a high-speed machine as described above, when a sheet jam occurs, total 5 to 10 sheets may jam at each part of the sheet transporting paths in the apparatus for the reasons such that the sheets are transported at reduced intervals for high-speed printing, the size of the apparatus is large to address high-speed printing, and the sheet transporting paths are complicated and long. Therefore, as compared with an intermediate-speed or low-speed machine, there is a tendency that the work of removing the jammed sheets is complicated. Since it increases the burden on the user, an apparatus for easily removing the jammed sheets has been requested.

To address the request, a method of unitizing a part of the apparatus and enabling the unit to be pulled from the body to largely open the sheet transporting paths when removing the remaining sheets in the apparatus has been proposed. With such a configuration, visibility and operability of the user is improved. An apparatus is also known such that a unit which can be pulled is divided into a plurality of units to address the complicated shape of the sheet transporting paths, a first unit is pulled from the body to the front side (the direction orthogonal to the sheet transporting direction), and then a second unit is pulled to the front side from the first unit (refer to, for example, Japanese Patent Laid-open No. Hei 10-143046).

The method of dividing the unit which can be pulled into a plurality of units is particularly effective to the following case. In the case where a switchback section for duplex printing exists in one of the sheet transporting paths, the sheet transporting path may be constructed so that the transported sheet is turned around in a small radius. In such a case, by pulling the first unit, the sheet transporting paths for simplex printing can be mainly opened. Further, by pulling the second unit, the sheet transporting path(s) for duplex printing including the switchback section can be opened.

As another method of pulling a plurality of units, a method of pulling the first unit to the front side from the body and pulling the second unit to a sheet evacuation side (the sheet transporting direction) or a sheet feed side (the direction opposite to the sheet transporting direction) from the body is known.

However, the method of pulling the units in two stages to the front side requires assurance of a large space on the front side so that the units can be pulled. The method of pulling the first unit to the front side and pulling the second unit to the sheet evacuation side or sheet feed side does not require a large space on the front side but requires a space on the sheet feed side or the sheet evacuation side. In many cases, a finisher is attached to the sheet evacuation side and a large-capacity sheet feeder and the like is attached on the sheet feed side. To pull the units, such peripheral apparatuses have to be moved, so that the operation is troublesome. Further, the user has to perform a work of removing sheets on the front side and, further, a work of removing sheets on the sheet evacuation side or sheet feed side. Also from the viewpoint that the user has to change his/her position, the work is troublesome. Another method is therefore considered in which the first unit is pulled in a first direction (for example, to the front side) to open a sheet transporting path in a state where a photoconductor and a developing unit are left in the body and, further, a second unit is pulled from the first unit to a second direction (for example, to the sheet evacuation side) to open the sheet transporting path in the first unit.

In such a manner, a large occupation area is not required and, moreover, sheets can be removed nearby, so that the burden on the user is lighter.

In the method of pulling the first unit to the first direction and pulling the second unit from the first unit to the second direction different from the first direction, as long as the second unit is housed in the first unit, pulling the first unit from the body and pushing back the first unit to the body causes no trouble. However, in a state that the second unit is pulled from the first unit, pushing back the first unit into the body causes trouble because the pulled second unit collides with a side face of the body. As a result, there is the possibility such that the second unit, the first unit, or the body is damaged or deformed and necessary mechanism precision cannot be assured.

SUMMARY OF THE INVENTION

The present invention has been achieved in consideration of such circumstances and provides an image forming apparatus in which a first unit can be housed in the body when the user performs a predetermined operation to house the first unit into the body, thereby preventing the first unit from being inadvertently housed in the body.

The present invention provides an image forming apparatus including: an apparatus body; a first unit which can be pulled/pushed from/to the body along a first direction and which includes at least a part of an image forming section for forming an image and/or of a sheet transporting section for transporting a sheet onto which the formed image is transferred, and; a second unit which can be pulled/pushed from/to the first unit along a second direction in a state where the first unit is pulled from the body, the second direction being different from the first direction; and a housing permitting mechanism for permitting the first unit to be pushed into the body by a predetermined operation, the housing permitting mechanism being provided for at least one of the body and the first unit.

Since the image forming apparatus of the invention has the housing permitting mechanism which permits the first unit to be pushed into the body when a predetermined operation is performed, a situation can be prevented such that the first unit is inadvertently housed into the body, the pulled second unit collides with the body, the second unit, the first unit, or the body is damaged or deformed and necessary mechanism precision cannot be assured.

BRIEF DESCRIPTION OF THE DRAWINGS

FIG. 3 is a diagram showing a state where a plurality of transporting paths are switched by a plurality of branch claws disposed in the image forming apparatus according to the invention;

DETAILED DESCRIPTION OF THE PREFERRED EMBODIMENTS

Figure 1:
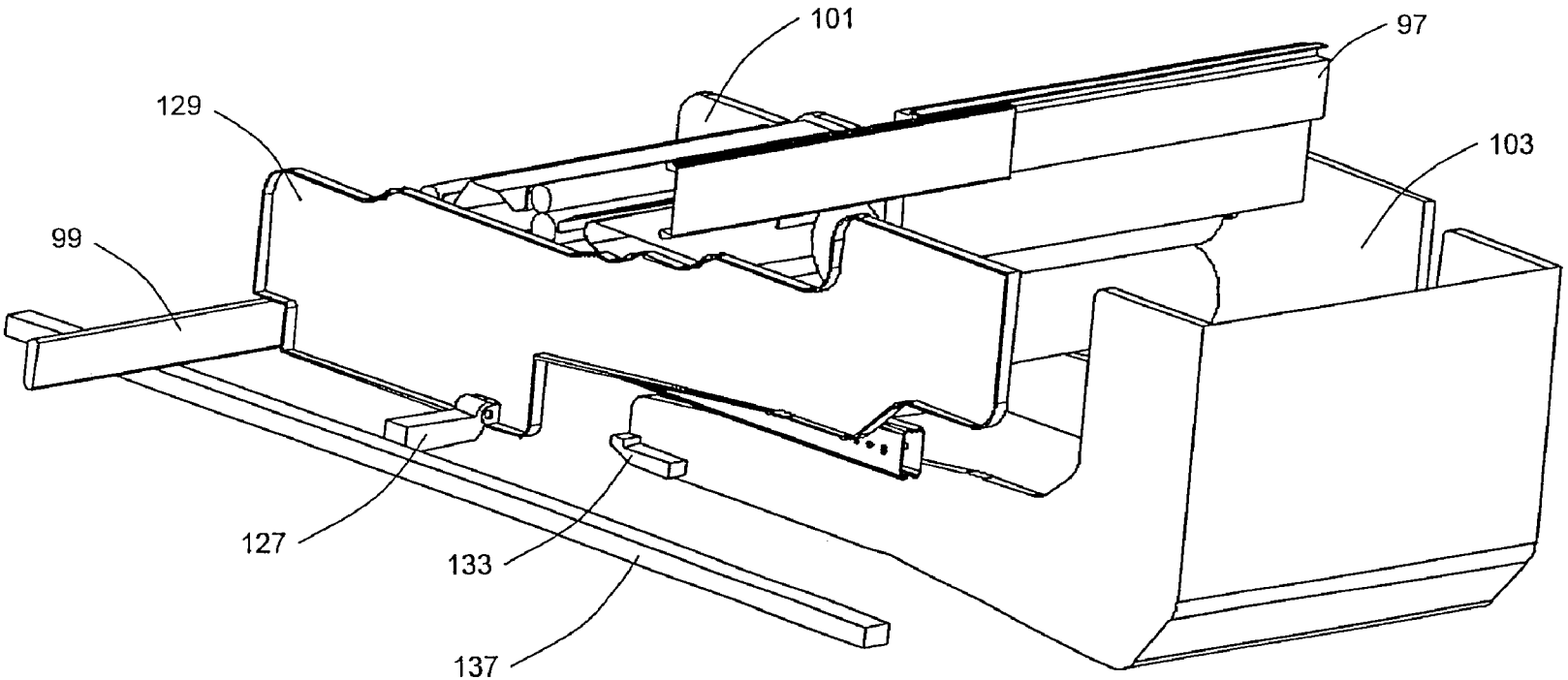
FIG. 1 is a perspective view showing a state in which a second unit is pulled from a first unit and the other end of a stopper is positioned at a swing end below in a second embodiment according to the invention (second embodiment)

As each of the first and second units regarding the present invention, a unit which can be pulled from the body when a sheet jam occurs is mainly assumed. By making a mechanism of units and pulling any of the units from the body, when a sheet jam occurs, sheet transporting paths are opened and the jammed sheets in the apparatus can be easily removed. However, the unit of the invention is not limited to the above-described unit. A mechanism for accessing the inside of the apparatus may be also employed for the purpose of periodical replacement or maintenance performed by the user or a service engineer. A example of such a mechanism is a cleaner for removing residual toner on a transfer roller and a transfer belt and a cleaner for a charging device. However, the invention is not limited to the above.

In a concrete embodiment, a transfer mechanism, a fuser unit, and sheet transporting paths around them are disposed in the first unit, and an duplex printing mechanism and sheet transporting paths are disposed in the second unit. In a different mode, for example, a fuser unit may be provided on the body side. A photoconductor and units disposed around the photoconductor such as a charging unit, a developing unit, and a cleaner unit may be disposed in the first unit. A duplex printing mechanism and sheet transporting paths may be disposed in the first unit and sheet transporting units may be disposed in the second unit. The invention is not limited to the modes. The invention includes various modes in which by pulling the first and second units, the user or a service engineer can access an image forming section and/or a sheet transporting path in the apparatus.

The image forming apparatus according to the invention may further include: a rail fixed to the body and extending in the first direction and a moving member fixed to the first unit and moving along the rail. The housing permitting mechanism is a press section using an slastic member, being disposed in one or more places in the rail and pressing the moving member with elasticity of the elastic member when the moving member passes, and the predetermined operation is an operation of pushing the first unit against a press force of the press section. With the configuration, at the time of housing the first unit into the body, the first unit has to be pushed with a force larger than a predetermined force. Consequently, situations can be prevented such that the first unit slides due to a slight tilt and dead load balance, and the user erroneously touches the first unit, causing collision between the second unit and the body.

The press section may make the elastic member come into direct contact with the moving member. Alternatively, the contact part may be a member different from the elastic member, and the press section may be constructed by combining the members. A single press section may be provided near the end position in which the first unit is pulled. A plurality of press sections such as detention mechanisms for suppressing movement of the first unit may be provided in a portion in which the first unit is pulled.

In the image forming apparatus according to the invention, the predetermined operation may be an operation of pushing the second unit pulled from the first unit to a predetermined position in the first unit, and the housing permitting mechanism may be a mechanism of suppressing housing of the first unit into the body when the second unit is pulled from the first unit more than the predetermined position. With such a configuration, housing of the first unit to the body is suppressed by the housing permitting mechanism when the second unit is pulled more than the predetermined position from the first unit. Thus, when the second unit is pulled, the first unit is reliably prevented from being housed, and the second unit is prevented from colliding with the body.

In the image forming apparatus according to the invention, the housing permitting mechanism may include a suppressing member and a moving mechanism, the suppressing member being attached to the first unit and can move between a suppress position and a release position, and the moving mechanism being provided for moving the suppressing member to the suppress position when the second unit is pulled from the first unit more than the predetermined position. The suppress position may be a position in which the suppressing member comes into contact with the body, and the release position may be a position in which the suppressing member does not come into contact with the body. With such a configuration, the housing permitting mechanism can be realized with a simple mechanism which is moved according to the position of the second unit.

The movable suppressing member means, for example, that the suppressing member is swingably attached. The invention is not limited to the mode. The mode of movement is not limited as long as the member moves between the suppress position and the release position. For example, the suppressing member may move in parallel or move while changing the angle.

In the image forming apparatus according to the invention, the moving mechanism may include a link member which is supported by the second unit and can be come into contact with the suppressing member, and an energizing member for energizing the suppressing member toward the suppress position. The link member may come into contact with the suppressing member to move the suppressing member to the release position when the second unit is pushed to a predetermined position in the first unit. The link member may be apart from the suppressing member to permit the suppressing member to move to the suppress position when the second unit is pulled more than the predetermined position.

In the image forming apparatus according to the invention, the link member may move the suppressing member to the release position when the second unit is pushed to a position in which contact between the second unit and the body is avoided even if the first unit is housed in the body. With such a configuration, when the second unit is pushed to the position in which contact between the second unit and the body is avoided, the suppressing member moves to the release position, and the first unit is permitted to be housed in the body. Thus, collision between the second unit and the body can be avoided with reliability.

The image forming apparatus according to the invention may further include: a suppressing member position detector for detecting that the suppressing member is in the suppress position; and a notifying section for notifying of the fact that housing of the first unit to the body is suppressed when the suppressing member is in the suppress position on the basis of detection of the suppressing member position detector. With the configuration, by notifying of the fact that housing of the first unit to the body is suppressed, a situation can be avoided such that the user applies an excessive force to house the first unit to the body without noticing that the suppressing member is in the suppress position, thereby damaging the body or the first unit.

The suppressing member position detector may detect the position of the suppressing member by, for example, disposing a microswitch or a reflection-type photosensor at a predetermined position. It is also possible to dispose a transmission-type photointerrupter near the suppressing member and fix a slit plate interrupting an optical path to the suppressing member. The notifying section may be realized by displaying a message on an operation panel provided for the image forming apparatus and providing the interface to the user. Alternatively, the notification may be performed by providing a predetermined display lamp on the operation panel and turning on the display lamp. The configuration of the suppressing member position detector and the notifying section is not limited to the above. The configuration may be a mechanical configuration such that the position of the suppressing member and a display for displaying a message on a display window provided on the front side of the body are linked to each other mechanically by a linking mechanism and display of the display window is changed by turning the display plate in accordance with the position of the suppressing member.

The image forming apparatus according to the invention may further include: a second unit position detector for detecting that the second unit is in the predetermined position; and a notifying section for notifying of the fact that housing of the first unit to the body is suppressed when the second unit is in a position other than the predetermined position on the basis of detection of the second unit position detector. Similar effects as those in the detection and notification by the suppressing member position sensor are obtained by detecting the position of the second unit in place of the suppressing member and notifying of the fact that housing of the first unit to the body is suppressed. Specifically, a situation can be avoided such that the user applies an excessive force to house the first unit to the body without noticing that the suppressing member is in the suppress position, thereby damaging the body or the first unit.

The present invention will be described in detail below with reference to the drawings. By the following description, the invention will be further understood. However, the following description is to be considered in all respects as illustrative and not restrictive.

Description of Operation of Imaging Apparatus

Figure 2:
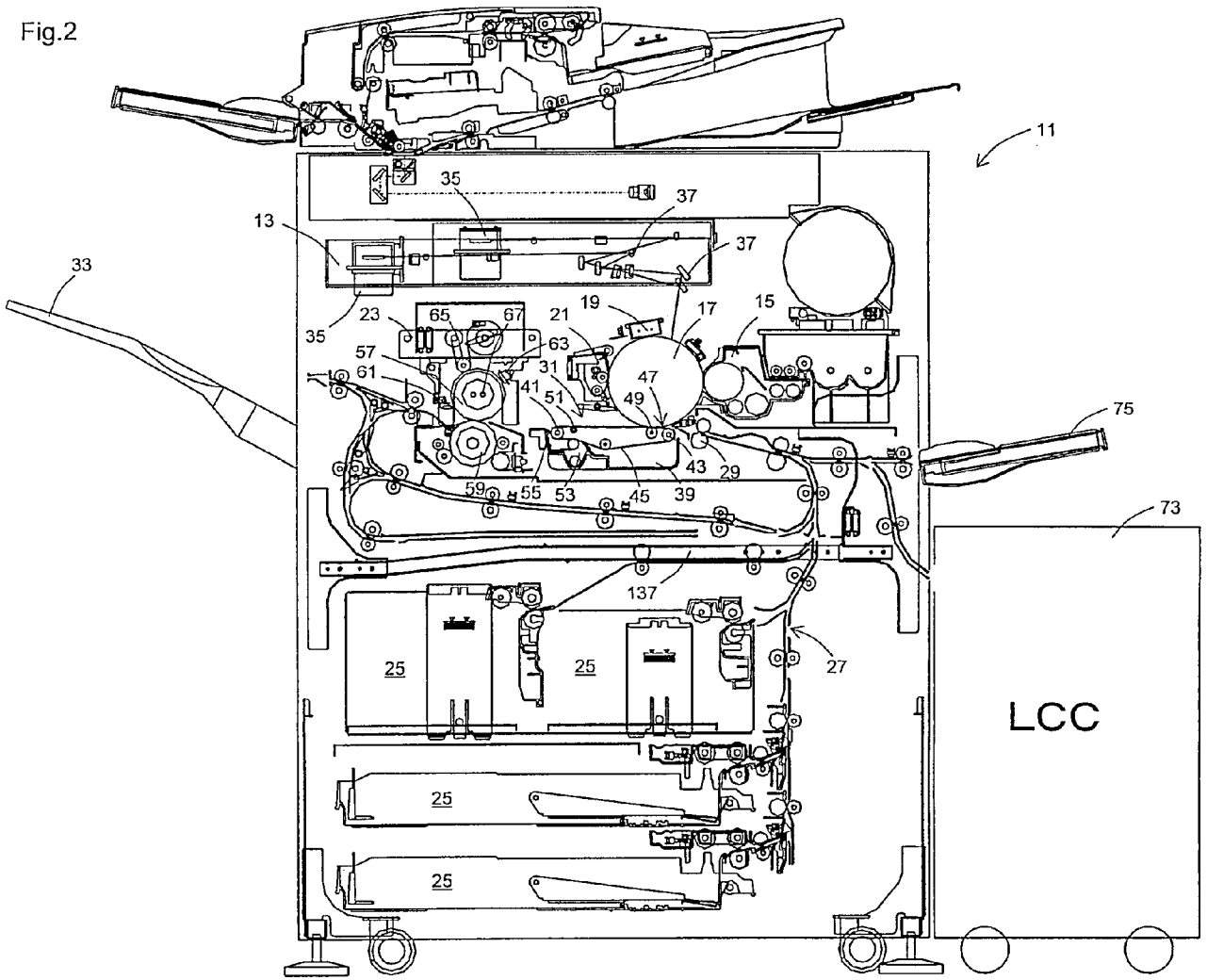
FIG. 2 is a diagram showing the configuration of an image forming apparatus according to the invention.

FIG. 2 is a diagram illustrating the configuration of an image forming apparatus 11 according to the present embodiment.

The image forming apparatus 11 forms a monochrome image on a predetermined sheet (recording sheet) in accordance with image data received from the outside. As shown in FIG. 2, the image forming apparatus 11 includes an exposure unit 13, a developing unit 15, a photoconductor 17, a charging unit 19, a cleaner unit 21, and a fuser unit 23. Further, the image forming apparatus 11 includes a sheet feeding tray 25, a sheet feeding path 27, a sheet transporting path 31, and a sheet exit tray 33. The sheet feeding path 27 is a path extending upward from the sheet feeding tray 25. The sheet transporting path 31 is a path extending from the terminating end of the sheet feeding path 27 to a sheet exit roller 95 via a resist roller 29, a transfer belt 45, and the fuser unit 23.

The charging unit 19 is provided for uniformly charging the surface of the drum of the photoconductor 17 to a predetermined potential. In the embodiment, the charging unit 19 in a charger type is used as shown in FIG. 2. The charging unit 19 may be of a contact roller type or brush type.

The exposure unit 13 is a laser scanning unit (LSU) having a laser emitting unit 35 and a reflection mirror 37 for emitting a laser beam that scanned in the rotary axis direction of the photoconductor 17 as shown in FIG. 2. As another mode, there is also a method of using an EL or LED writing head in which light emitting elements are arranged in an array. Since high-speed printing process is performed, the image forming apparatus 11 of the embodiment employs a method of performing a high-speed scan using a plurality of laser beams (2-beam method).

The exposure unit 13 exposes the photoconductor 17 which is uniformly charged by the charging unit 19 in accordance with input image data. By the exposure, an electrostatic latent image according to the image data is formed on the surface of the photoconductor 17.

The developing unit 15 makes the electrostatic latent image formed on the photoconductor 17 visible by using toner. The cleaner unit 21 removes/collects residual toner on the surface of the photoconductor 17 after development and transfer.

The toner with which the image is made visible on the photoconductor 17 as described above is transferred onto a sheet of paper transported on the sheet transporting path 31. A transfer mechanism 39 (in apparatus, a transfer belt unit) is a mechanism for transferring toner onto the sheet by applying an electric field of the polarity opposite to that of the charges held in the toner. For example, when an electrostatic latent image bears charges having the negative (−) polarity, the polarity of charges applied to the transfer mechanism 39 is the positive (+) polarity.

The transfer mechanism 39 of the apparatus has the transfer belt 45 hung over a drive roller 41, a driven roller 43, and other rollers and having a predetermined resistance value (the range of $1\times10^{9}$ to $1\times10^{13}$ Ω·cm). In a contact part 47 between the photoconductor 17 and the transfer belt 45, an elastic conductive roller 49 which is a roller different from the drive roller 41 and the driven roller 43 and can apply a transfer electric field is disposed. The elastic conductive roller 49 has elasticity. By the property, the photoconductor 17 and the transfer belt 45 have face contact with a predetermined width (called a transfer nip), not line contact. Consequently, the efficiency of transfer to a sheet of paper transported can be improved.

Further, on the downstream side of the transfer region of the transfer belt 45, a discharging roller 51 is disposed. The discharging roller 51 neutralizes the sheet of paper charged by the applied voltage when the sheet passes through the contact part 47 to make the sheet of paper smoothly carried to the next process. The discharging roller 51 is disposed on the back face of the transfer belt 45.

Further, in the transfer mechanism 39, a cleaning unit 53 and a discharging mechanism 55 for removing the residual toner on the transfer belt 45 and neutralizing the transfer belt 45 are disposed. The discharging mechanism 55 can employ a method of connecting the discharging mechanism 55 to the ground or a method of positively applying an electric field having the polarity opposite to that of the transfer electric field.

The toner transferred onto the sheet of paper by the transfer mechanism 39 is transported to the fuser unit 23.

The fuser unit 23 has a heat roller 57 and a pressure roller 59. A sheet separation claw 61, a roller surface temperature detecting member 63 (thermistor), and a roller surface cleaning member 65 are disposed in the outer peripheral part of the heat roller 57. In the inner peripheral part of the heat roller 57, a heat source 67 for heating the surface of the roller to a predetermined temperature (fixing setting temperature: about 160 to 200° C.) is disposed.

On the other hand, pressure members capable of making the pressure roller 59 come into contact with the heat roller 57 with a predetermined pressure amount are disposed at both ends of the pressure roller 59. Further, in the outer periphery of the pressure roller 59, like the outer periphery of the heat roller 57, the sheet separation claw 61 and the roller surface cleaning member 65 are disposed.

The sheet of paper on which the toner image is transferred is transported to the pressure contact part (called a fusing nip part) between the heat roller 57 and the pressure roller 59. In the fusing nip part, the fuser unit 23 heats the unfixed toner which is transferred to the sheet at the temperature of the surface of the heat roller 57 so as to be fused, and the unfixed toner on the sheet is fixed onto the sheet with the pressure force of the pressure roller by a riveting action.

The sheet feeding tray 25 is a tray for storing sheets (recording sheets) used for forming images. In the apparatus, the sheet feeding tray 25 is provided in the lower side of an image forming section and a side wall face. The apparatus is directed to realize a high-speed printing process, so that each of a plurality of sheet feeding trays 25 disposed below the image forming section can house 500 to 1,500 standard-sized sheets. On the other hand, on a side face of the apparatus, a large-capacity sheet feeding cassette 73 capable of housing 4,000 sheets and a manual sheet feeding tray 75 used mainly for performing printing on a non-standard-sized sheet are disposed.

The sheet exit tray 33 is disposed on the side face of the apparatus opposite to the manual sheet feeding tray 75. In place of the sheet exit tray 33, a post-treatment processor (finisher) for the evacuated sheets (an apparatus for performing processes such as stapling, punching, and the like), and a plurality of sheet exit trays 33 can be disposed.

The image forming apparatus 11 has a not-shown controller. The controller controls the operation of the image forming apparatus 11. The controller is constructed by, for example, a microcomputer, a ROM, a RAM, a nonvolatile memory, an input circuit, an output circuit, and the like. The ROM houses a control program as a procedure of processes executed by the microcomputer. The RAM provides the microcomputer with a work area. The nonvolatile memory holds so as to back up data necessary for control. To the input circuit, input signals from a sensor and a switch are connected, and the input circuit includes an input buffer and an A/D converter. The output circuit includes a driver for driving loads such as a motor, a solenoid, and a lamp.

A sheet transporting process executed in correspondence with image formation of the image forming apparatus 11 will be described in detail. By the microcomputer in the controller, a sheet addressing a printing request is selected from the plurality of sheet feeding trays 25. The selected sheet is fed from the sheet feeding tray housing the selected sheet and transported to the resist roller 29 via a transporting roller 93 in a transporting path. The transported sheet is temporarily stopped at the timing the tip of the sheet reaches the resist roller 29 under control of the microcomputer. The microcomputer makes the resist roller 29 re-rotate at timing so that the tip of the sheet synchronized with the image formed on the photoconductor 17. By the re-rotation, the sheet is transported to the transfer mechanism 39. In the transfer mechanism 39, the toner corresponding to image information is transferred onto the sheet. After that, the sheet is led to the fuser unit 23, and the toner transferred onto the sheet is fixed on the sheet. Subsequently, the sheet is evacuated to the sheet exit tray 33. The microcomputer controls a method of transporting a sheet over the fuser unit 23 to the sheet exit tray 33 in accordance with a printing mode (a copier mode, a printer mode, a facsimile mode, or the like) and a printing process method (simplex printing, duplex printing, or the like). Usually, in the copier mode, the user stays near the apparatus and performs various operations. For convenience of the user, sheet transporting control is often performed so that a sheet is evacuated with a printing surface facing upward. The operation is called "face-up evacuation". On the other hand, in each of the printer mode and the facsimile mode, in many cases, the user does not stay near the apparatus. Consequently, a "face-down evacuation" method capable of arranging the page order of evacuated sheets by a simple configuration and process is often used.

The apparatus has a mechanism capable of switching between the face-up evacuation and the face-down evacuation in accordance with the printing mode. The switching mechanism is formed by disposing a plurality of transporting paths and a plurality of branch claws before the evacuation position of the sheet exit tray 33. Sheets can be evacuated in accordance with the printing mode.

Switching of Sheet Feeding Paths

FIG. 3 is a diagram illustrating a state where a plurality of transporting paths are switched by the plurality of branch claws disposed in the image forming apparatus 11. In the following, the details of switching the sheet feeding paths 27 will be described with reference to FIG. 3.

As shown in FIG. 3, a branch claw A 77 is provided to switch between a transporting path A 79 for leading a sheet to the sheet exit tray 33 and a transporting path B 81 for leading a sheet to a switchback or the resist roller 29. The microcomputer drives claw position switching means (such as a solenoid) to switch the position of the branch claw A. A branch claw B83 is energized by an elastic member (such as a spring) disposed in a branch claw holding shaft 125 to shield the transporting path B 81. A sheet fed from the transporting roller 93 side to the transporting path B 81 passes through the branch claw B by the hardness of the tip of the sheet and the transporting force. On the other hand, a sheet fed from the branch claw B 83 side to the transporting path B 81 can be interrupted. A branch claw C 85 switches a sheet among the transporting path C 84 for leading a sheet to the resist roller 29, a transporting path E 90 for leading a sheet to the switch back section, and a transporting path D87 for leading a sheet from the switch back section to the sheet exit tray 33. Further, a branch claw D 89 switches between a transporting path F 91 for leading a sheet to the switch back section and a transporting path C 34. The microcomputer drives claw position switching means (solenoids or the like) corresponding to the branch claw C 85 and the branch claw D and thereby can independently switch the positions of the branch claw C 85 and the branch claw D. A branch claw E 92 is fixed.

1) Face-up Evacuation in Simplex Printing

The microcomputer switches the position of the branch claw A 77 so as to open the transporting path A 79 and close the transporting path B 81 at a timing just before a sheet passed through the fuser unit 23 passes through the transporting roller 93. The tip of the transported sheet is led to the branch claw A 77, passes through the transporting path A 79, and evacuated to the sheet exit tray 33 via the sheet exit roller 95.

2) Face-down Evacuation in Simplex Printing

The microcomputer switches the position of the branch claw A so as to open the transporting path B 81 and close the transporting path A 79 at a timing just before a sheet passed through the fuser unit 23 passes through the transporting roller 93. Further, the microcomputer switches the position of the branch claw C to open the transporting path C 34 and closes the transporting path E 90. The tip of the transported sheet is led to the branch claw A 77 and passes through the transporting path B 81. Further, the tip of the sheet passes through the branch claw B and reaches the branch claw B by the hardness of the tip of the sheet and the transporting force. After that, the tip of the sheet is led to the branch claw C and led to the transporting path C 84. When the rear end of the sheet reaches the position of the branch claw E 92, the microcomputer temporarily stops transporting of the sheet. The microcomputer switches the position of the branch claw C to open the transporting path D 87 and close the transporting path E 90. As described above, the branch claw B is energized by an elastic member and closes the transporting path B 81. In such a manner, after switching of the position of the branch claw C, the microcomputer makes a reverse transporting roller 94 inversely rotate to transport the sheet in the direction opposite to the entry direction. The sheet passes the transporting path D 87 setting, as the tip side, the side close to the branch claw E 92, that is, the rear end side at the time of entry to the transporting path C 84, and is evacuated to the sheet exit tray 33 via the sheet exit roller 95.

3) Evacuation in Duplex Printing

After completion of printing on a first face (surface) and just before a sheet which has passed through the fuser unit 23 passes through the transporting roller 93, the microcomputer switches the position of the branch claw A 77 to open the transporting path B 81 and close the transporting path A 79. Further, the microcomputer switches the position of the branch claw C to open the transporting path E 90 and close the transporting path C 84. The microcomputer switches the position of the branch claw D to open the transporting path D 87. The tip of the transported sheet is led to the branch claw A 77 and passes through the transporting path B 81. Further, the tip of the sheet passes through the branch claw B by the hardness of the tip of the sheet and the transporting force. After that, the tip of the sheet is led to the branch claw C, passes through the transporting path E 90, and is led to a transporting path F 91. When the rear end of the sheet reaches the transporting path F 91, the microcomputer temporarily stops transportation of the sheet (completion of switch back of the first face). The microcomputer switches the position of the branch claw D to close the transporting path E 90 and open the transporting path C 84. After that, the microcomputer makes a switchback roller 105 reversely rotate to transport the sheet in the direction opposite to the direction at the time of entry to the switchback section. The sheet passes through the branch claw E 92 in a state where the rear end side at the time of entry to the transporting path F 91 is set as the tip, and is led to the transporting path C 84. After that, the sheet is transported to the resist roller 29 disposed just before the print process (the transfer mechanism 39), and is transported onto the transfer belt 45 synchronously with an image. After printing on the second face (back side) is finished and the sheet passes through the fuser unit 23, the microcomputer switches the position of the branch claw A 77 to lead the sheet to the transporting path A 79 and to evacuate the sheet to the sheet exit tray 33.

First Unit 101, Second Unit 103, and Mechanism for Pulling the Units

Units and a mechanism for pulling the units, which are operated in the case where a jam occurs in the image forming apparatus 11 and a jammed sheet in the sheet transporting path 31 is removed, will be described.

Figure 4:
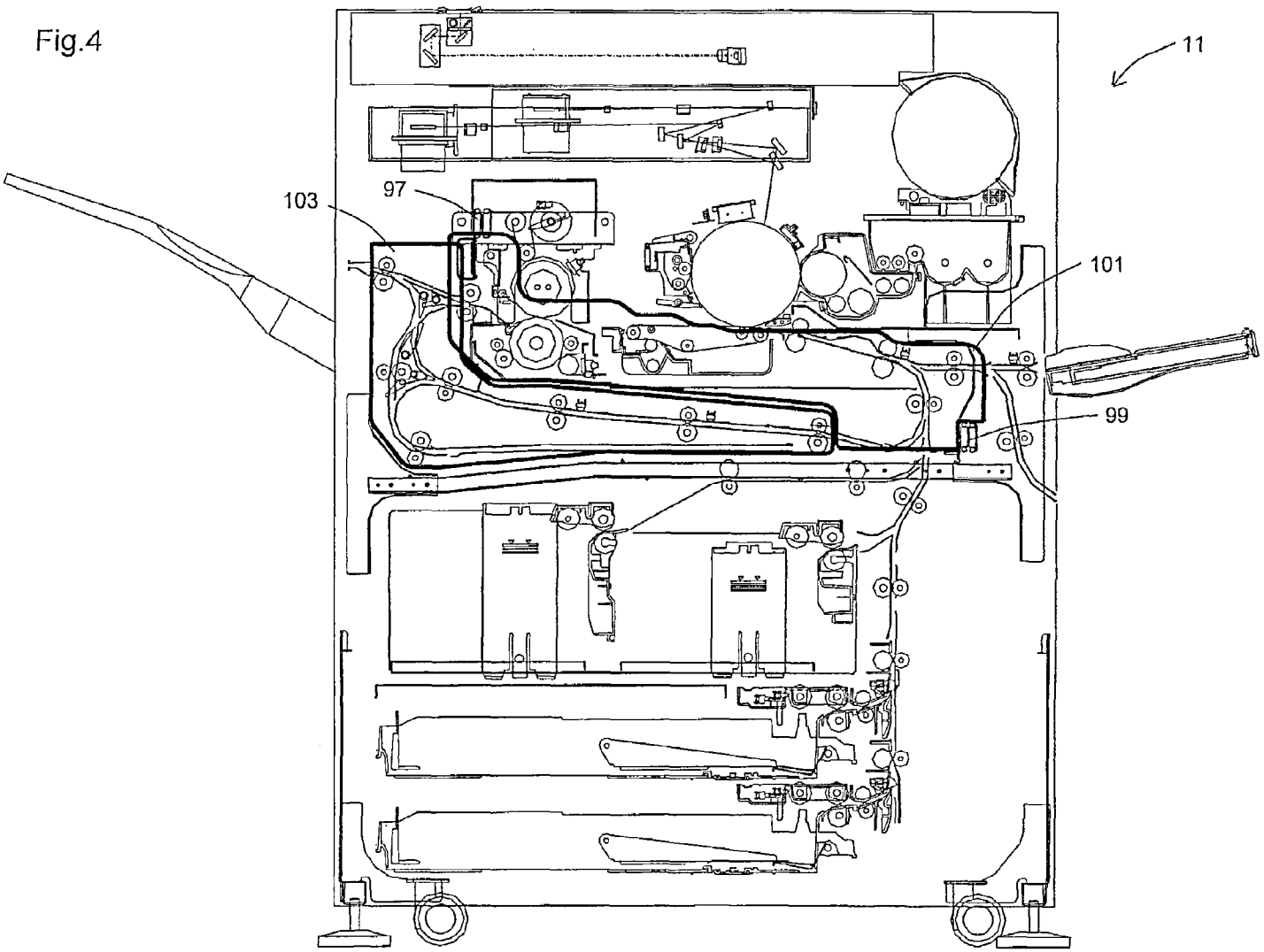
FIG. 4 is a diagram showing the outline of a pull part of a first unit and a second unit pulled from the image forming apparatus according to the invention.

FIG. 4 is a diagram illustrating the outer shape of a pulling part such as a first unit 101 and a second unit 103 which are pulled from the image forming apparatus 11. More specifically, FIG. 4 shows the outer shape of a frame on the front side of the first unit 101, the cover of the fuser unit 23, and the outer shape of the frame on the front side of the second unit 103. In FIG. 4, to highlight the portion pulled from the body, the first unit 101 and second unit 103 and the cover of the fuser unit 23 are illustrated with the thick solid lines. The first unit 101 is housed in the body of the image forming apparatus 11 and can be pulled to the front side of the drawing sheet of FIG. 4 along a guide rail A 97 and a guide rail B 99. The fuser unit 23 is supported by the first unit and is pulled together with the first frame. The second unit is housed in the body in a state where it is mounted in the first unit, and can be pulled from the first unit 101 to the sheet exit tray 33 side in a state where the first unit 101 is pulled from the body.

As shown in FIG. 4, the sheet transporting path 31 is provided above the first unit 101. When the first unit 101 is pulled from the body, the sheet transporting path 31 is exposed. The user can easily remove the sheet jammed in the sheet transporting path 31.

Figure 5:
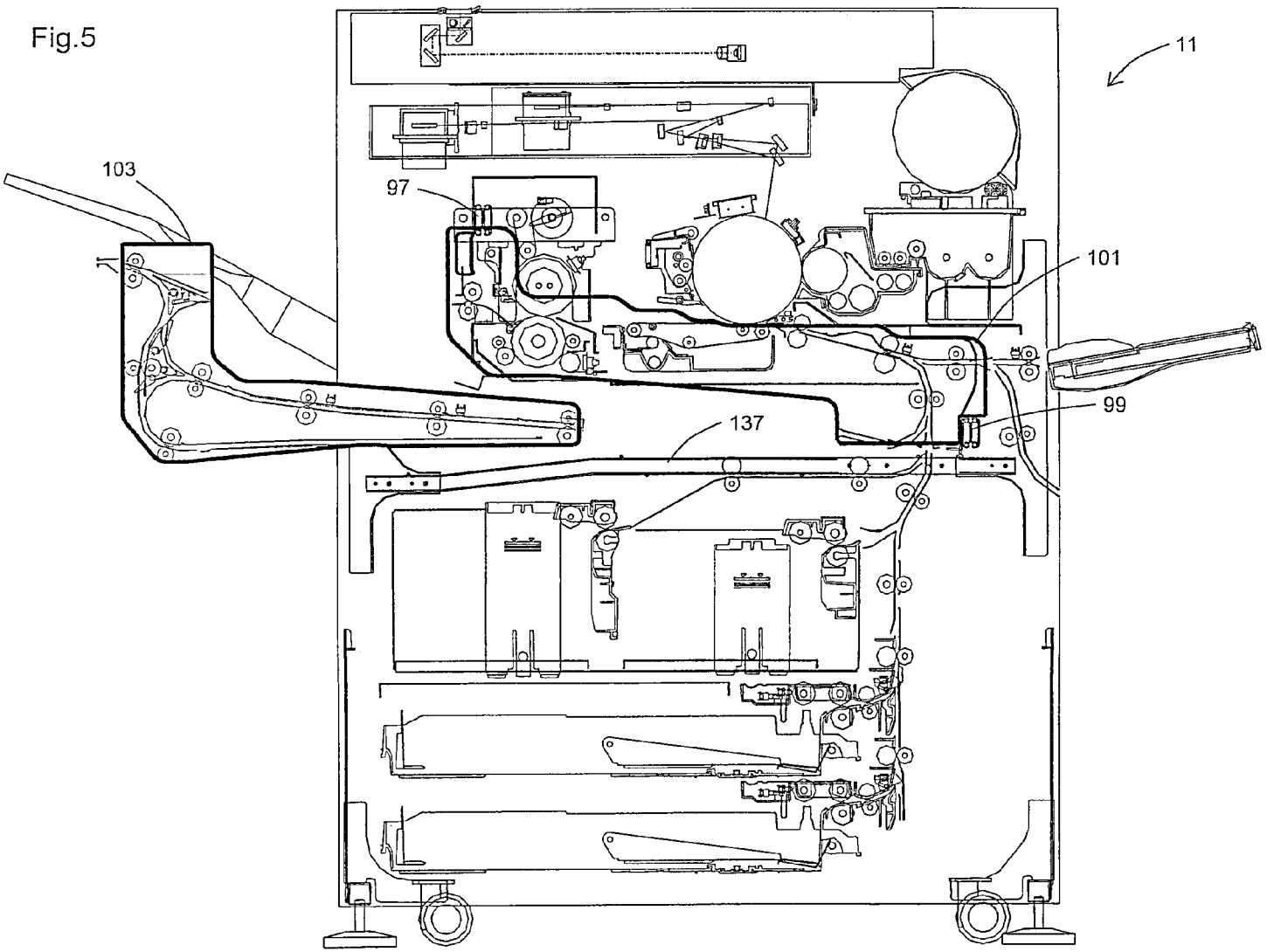
FIG. 5 is a diagram showing a state where the second unit is pulled from the first unit in the state where the first unit in FIG. 4 is pulled from the body.

FIG. 5 is a diagram illustrating a state where the first unit 101 is pulled from the body and, further, the second unit 103 is pulled from the first unit 101. As described with reference to FIG. 3, on the sheet exit tray 33 side of the second unit 103, the transporting path A 79 is provided on the top face, the transporting path B 81 is provided on the upper sheet feed side, and the transporting path D 87 and the transporting path E 90 are provided on the upper sheet evacuation side. Further, in a portion which is hidden behind the first unit 101 in a state where it is pushed by the first unit 101 and which is pulled from the first unit 101 and exposed, the transporting path C 84 and the transporting path F 91 exist. The transporting path C 84 exists on the upper side, and the transporting path F 91 exists on the lower side. The user can easily remove a sheet jammed in the transporting path A 79, the transporting path B 81, the transporting path C 84, the transporting path D 87, the transporting path E 90, and the transporting path F 91 by pulling the second unit 103 from the first unit 101.

Figure 6:
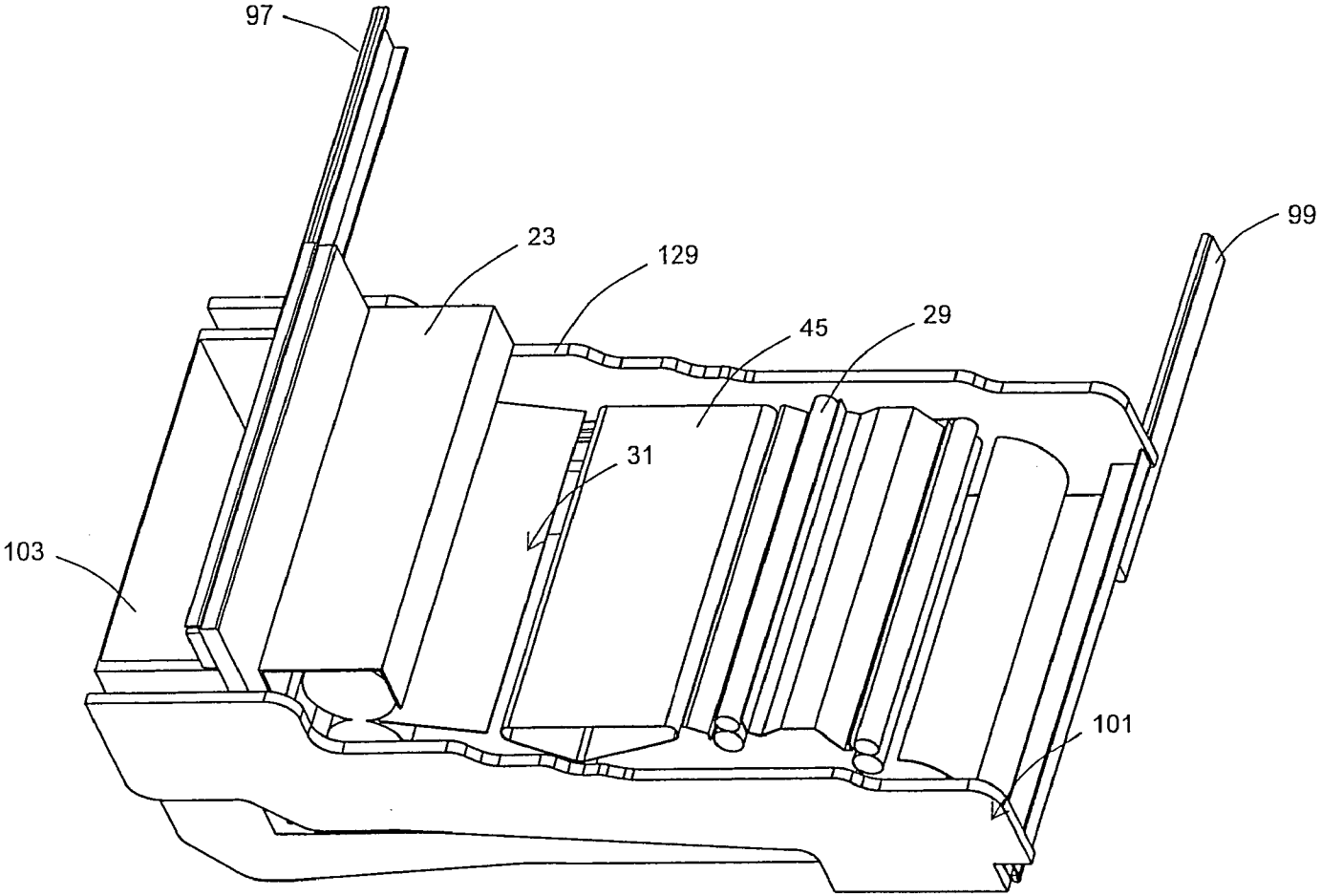
FIG. 6 is a perspective view showing a state where the first unit in FIG. 4 is pulled from the body.

FIG. 6 is a perspective view showing a state corresponding to FIG. 4 and a state where the first unit 101 is pulled from the body. As shown in FIG. 6, the sheet transporting path 31 is exposed on the upper side of the first unit 101.

Figure 7:
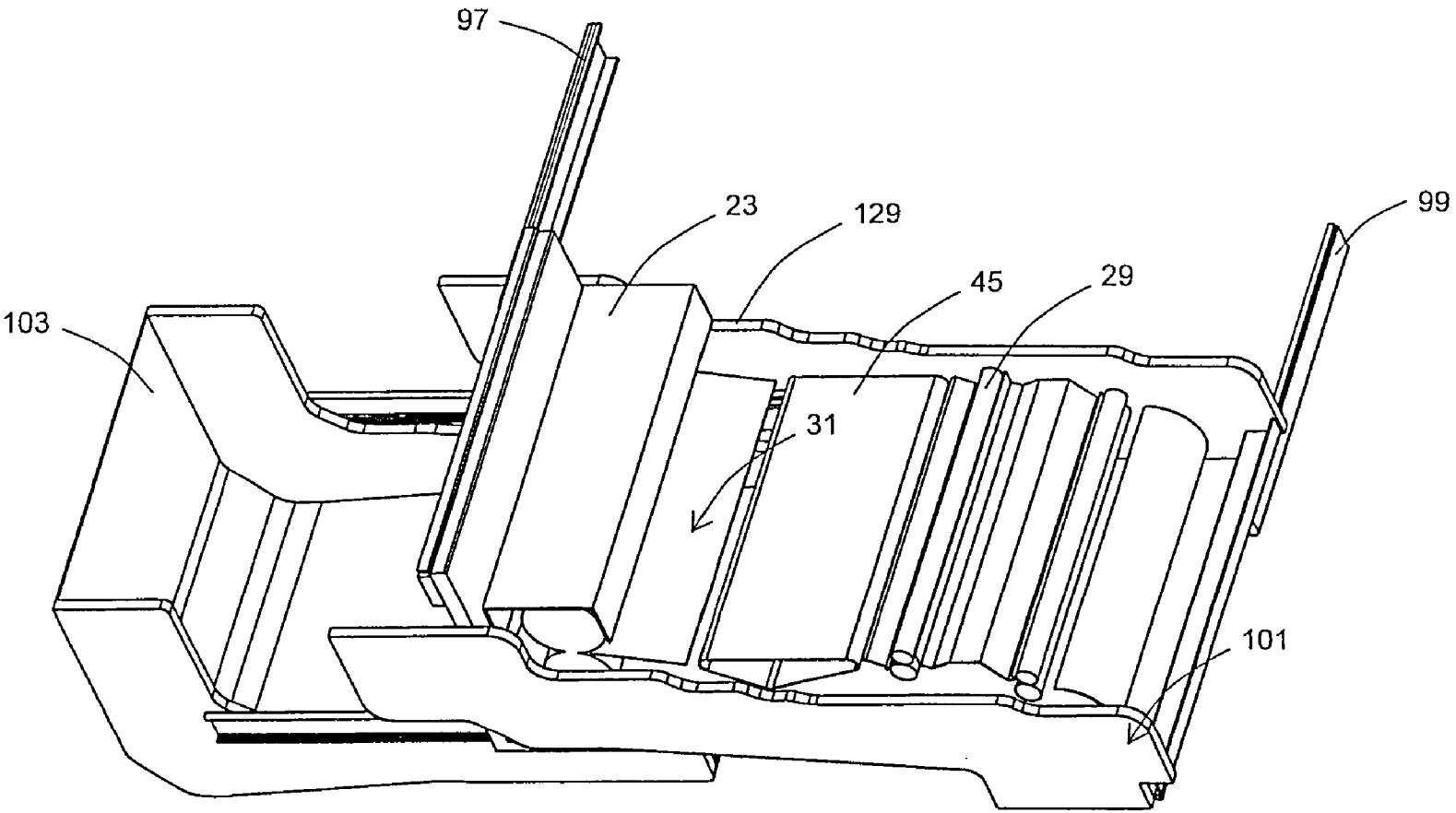
FIG. 7 is a perspective view showing a state where the second unit is pulled from the first unit from the state of FIG. 6.

FIG. 7 is a perspective view showing a state where the second unit 103 is pulled from the first unit 101 in the state of FIG. 6. FIG. 7 corresponds to the state of FIG. 5. In FIG. 7, the details of the transporting paths are not shown. When the second unit 103 is pulled, the transporting path C 84 hidden below the first unit 101 is exposed, and the transporting path B 81 between the first unit 101 and the second unit 103 is exposed. The transporting path A 79 is exposed on the upper side of the second unit 103, and the transporting path D 87 and the transporting path E are exposed on the sheet exit tray 33 side of the second unit 103. The transporting path F 91 in the switchback section is on the lower side of the second unit 103. However, the user can easily remove a sheet jammed in the transporting path F 91 by turning the switchback roller 105 in the transporting path F 91 by his/her hand.

Housing Permitting Mechanism of First Unit 101

As shown in FIG. 5 or 7, it is assumed that the first unit 101 is slidable in a state where the second unit 103 is pulled. When the first unit 101 is pushed into the body, the second unit 103 and a part of the body collide with each other. In many cases, a unit having the mechanism of being pulled from the body like the first unit 101 uses a bearing, a roller, and the like so that the unit can easily slide in consideration of ease of operation of the user. In this case, it is unpreferable that the first unit 101 slides by a slight force that the user or the like touches the unit because the second unit 103 and the body may collide with each other and the collision part is damaged or deformed. It is also unpreferable that the guide rail is slightly tilted with respect to the horizontal direction due to a slight tilt of the mount face and the first unit 101 slides by its dead load from the relation of weight balances of the unit. Further, when the first unit 101 is pushed into the body without consideration that the second unit 103 is pulled, it is feared that the collision part is damaged. In the state where the second unit 103 is pulled from the first unit, it is important to provide a mechanism of avoiding collision between the second unit 103 and the body.

First Embodiment

In the first embodiment, as a mode of the mechanism of avoiding collision between the second unit 103 and the body, a mode of providing a mechanism requiring a predetermined force for pushing the first unit 101 to the predetermined position or more will be described. By the mechanism, the first unit 101 can be prevented from being inadvertently housed.

Figure 8:
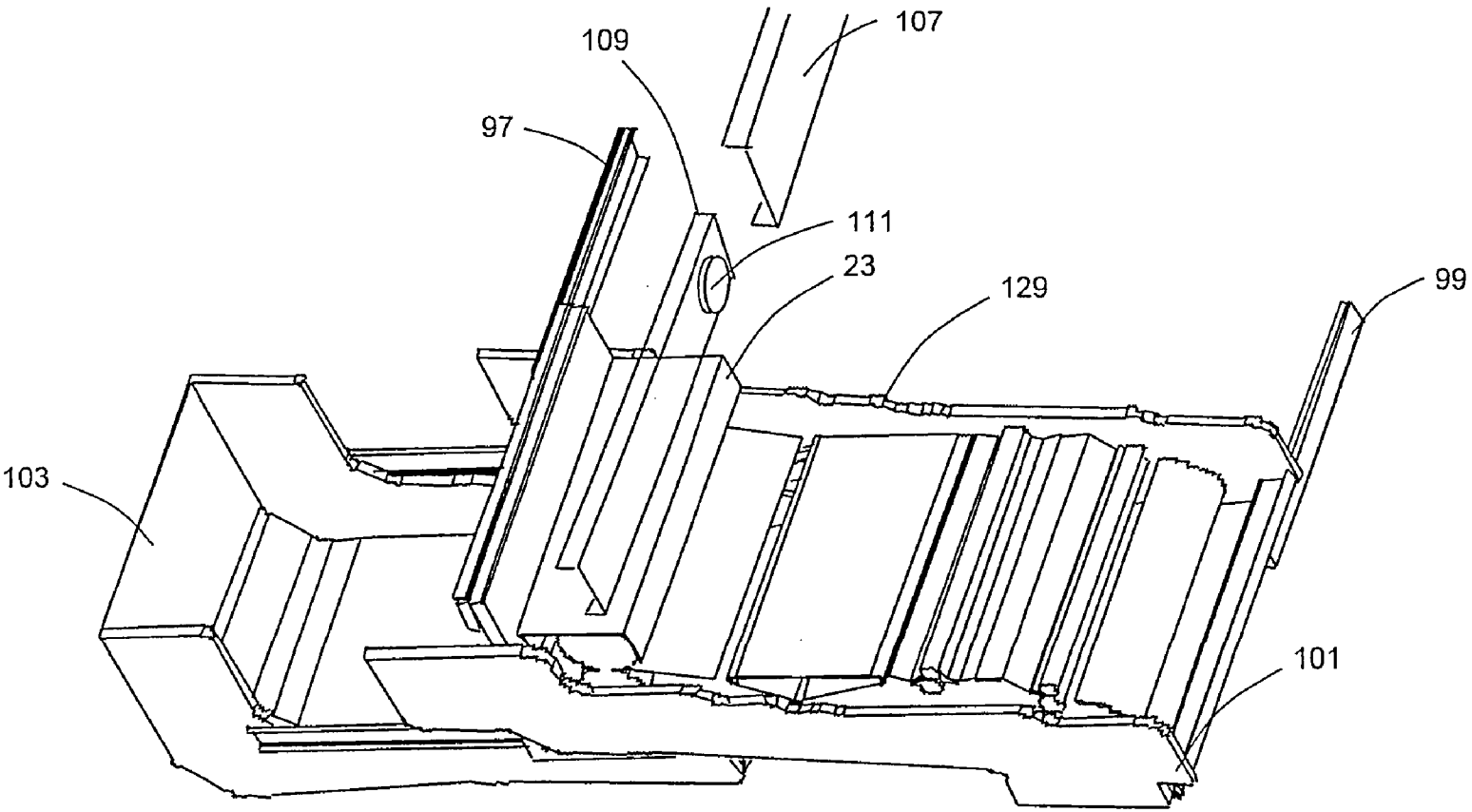
FIG. 8 is a diagram showing an example of a mechanism of suppressing housing of the first unit (first embodiment)

FIG. 8 is a diagram showing an example of the housing permitting mechanism of the embodiment. The housing permitting mechanism is provided for a fixed rail 107 extending in parallel with the guide rail A 97 and the guide rail B 99 for pulling the first unit 101. Specifically, a roller 111 provided for an arm 109 on the first unit 101 side moves along the fixed rail 107 as the first unit 101 slides, and the fixed rail 107 has a mechanism of suppressing movement of the roller 111.

Figure 9A:
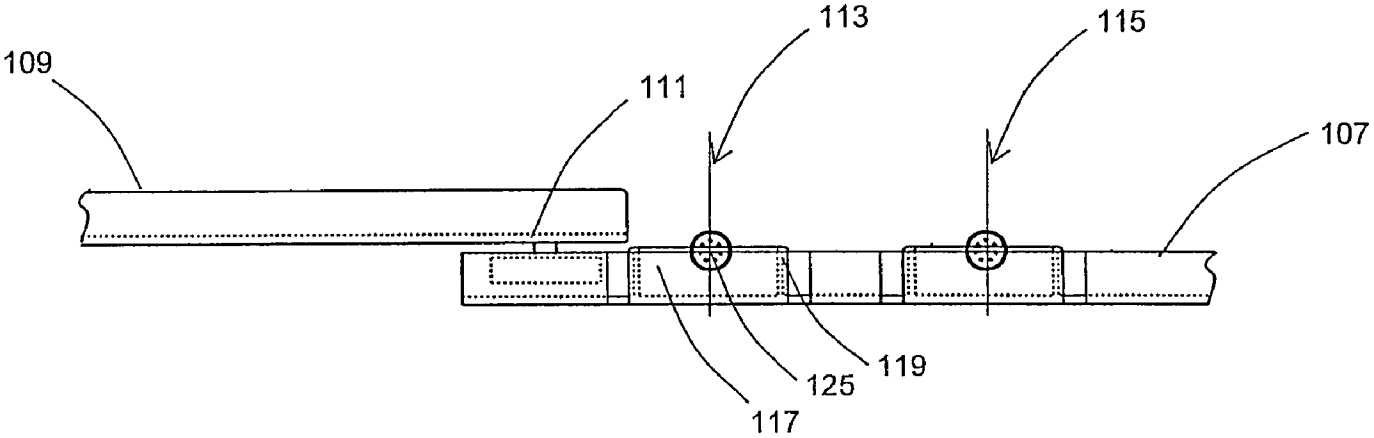
FIGS. 9A and 9B are diagram showing the details of a mechanism for suppressing sliding (first embodiment)
Figure 9B:
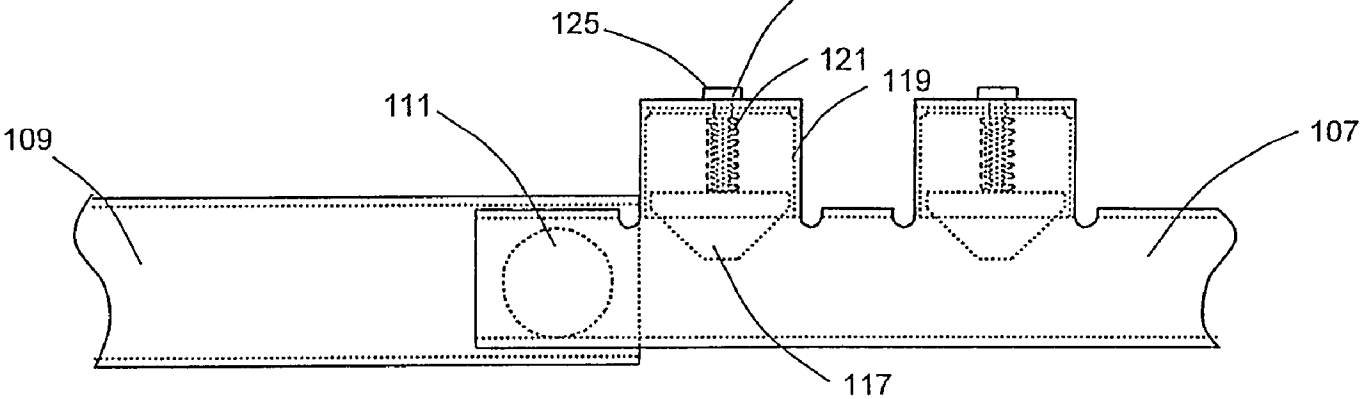

FIGS. 9A and 9B are diagrams showing the detail of the suppressing mechanism illustrated in FIG. 8. FIGS. 9A and 9B are a plan view and a front view, respectively. In FIGS. 9A and 9B, the fixed rail 107 is attached to the not-shown body side which is on the right part of the diagrams. The arm 109 is attached to the not-shown first unit 101 which is positioned in the left part of the diagrams. The roller 111 attached to the tip of the arm 109 moves while rotating on the fixed rail 107 when the first unit 101 is pushed or pulled.

In FIGS. 9A and 9B, press sections are provided in two places along the fixed rail 107. A first position 113 as the first place is a position near the place where the roller 111 is positioned when the first unit 101 is pulled to the terminating end. The second place is a second position 115 in some midpoint of the course of pushing the first unit 101 into the body. The press section in each of the positions is constructed by a press member 117, a housing 119, a press spring 121, and a shaft 125. The press member 117 presses the roller 111 passing along the fixed rail 107. The housing 119 regulates the moving direction of the press member 117 in the vertical direction. The press spring 121 energizes the press member 117 in the hosing 119 downward. The shaft 125 is inserted in a guide hole 123 opened in the top face of the housing 119. The press member 117 is fixed to the lower end of the shaft 125, and the upper end of the shaft 125 is a T-shaped head having a diameter larger than that of the guide hole 123. Consequently, the shaft 125 is fit so as not to come off from the guide hole 123. The press spring 121 is provided around the shaft 125.

When the roller 111 moves along the fixed rail 107 and passes through the press section, the periphery of the roller 111 and the lower end of the press member 117 come into contact with each other, and the press member 117 is pushed up. Consequently, the press spring 121 contracts and presses the roller 111 downward. The sectional shape in the direction along the fixed rail 107 of the press member 117 is an inverted trapezoid in which the upper base is larger than the lower base and is a shape obtained by vertically cutting the oblique lines near the upper base. When the periphery of the roller 111 is in contact with the lower base of the press member 117, the roller 111 is subjected to the largest downward press force. In a state where the periphery of the roller 111 is in contact with the oblique line, the press force applied on the roller 111 decreases as the roller 111 moves with distance from the center of the press member 117.

When the first unit 101 is pushed/pulled, the roller 111 is pressed by the press sections near the first and second positions, and the user operating the first unit 101 feels knocks. Therefore, in the case where the first unit 101 pulled to the terminating end is pushed into the body, when the roller 111 passes through the first positions 113 and second positions 115, a resistance force acts. If the first unit 101 is not pushed with a predetermined force larger than the resistance force, the sliding of the first unit 101 stops. That is, the first unit 101 is prevented from being inadvertently pushed into the body.

Second Embodiment

In a second embodiment, an example of the housing permitting mechanism having a suppressing member (a stopper 127) for preventing the first unit 101 from being housed when the second unit 103 is pulled will be described. The stopper 127 is provided to prevent the first unit 101 from being pushed further than a predetermined position by coming into contact with a part of the body.

Figure 10:
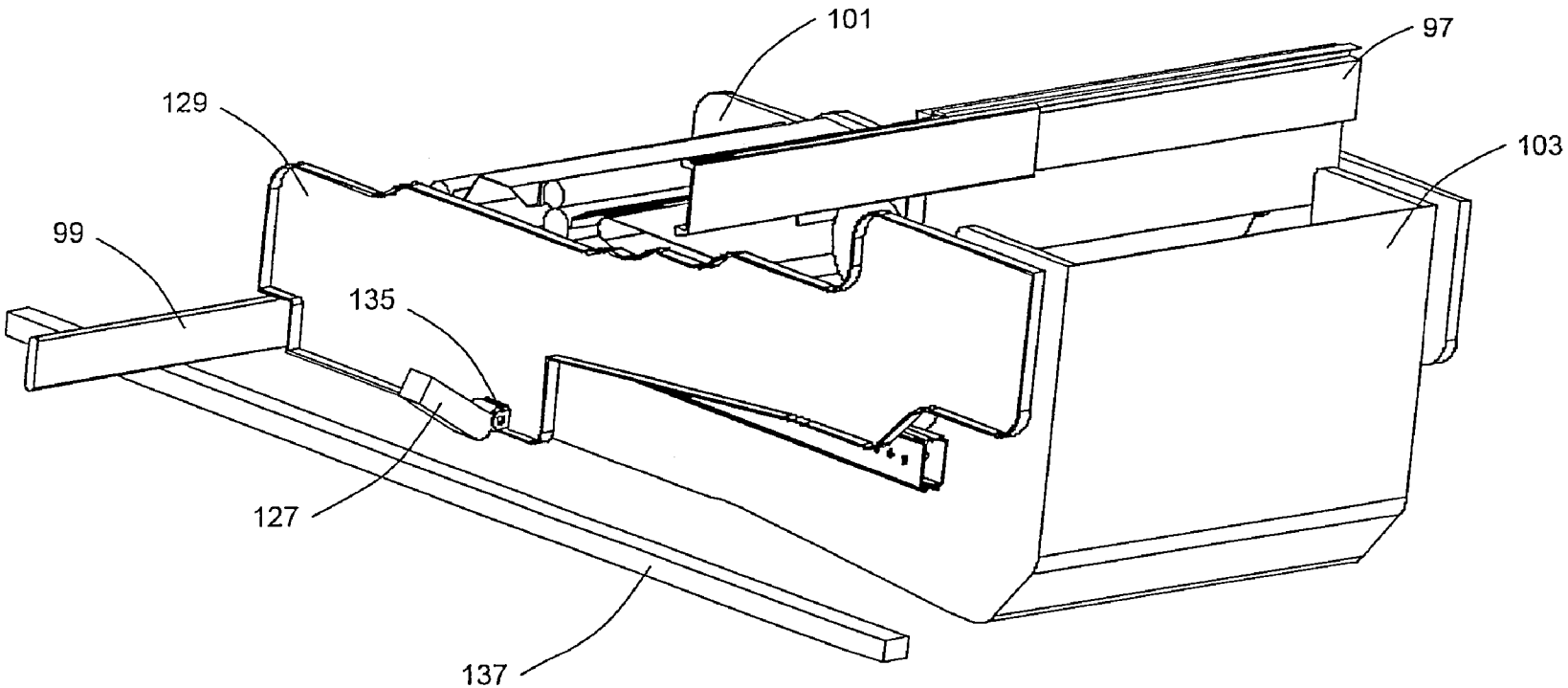
FIG. 10 is a perspective view showing a state where a stopper according to a second embodiment is attached to the first unit (second embodiment)

FIG. 10 is a perspective view showing a state where the stopper 127 of the second embodiment is attached to the first unit 101. When the pull side of the first unit 101 is set as the front side, the stopper 127 is attached to a back frame 129 of a side face on the side opposite to the pull side. The stopper 127 is attached movable along the back frame 129.

Figure 11:
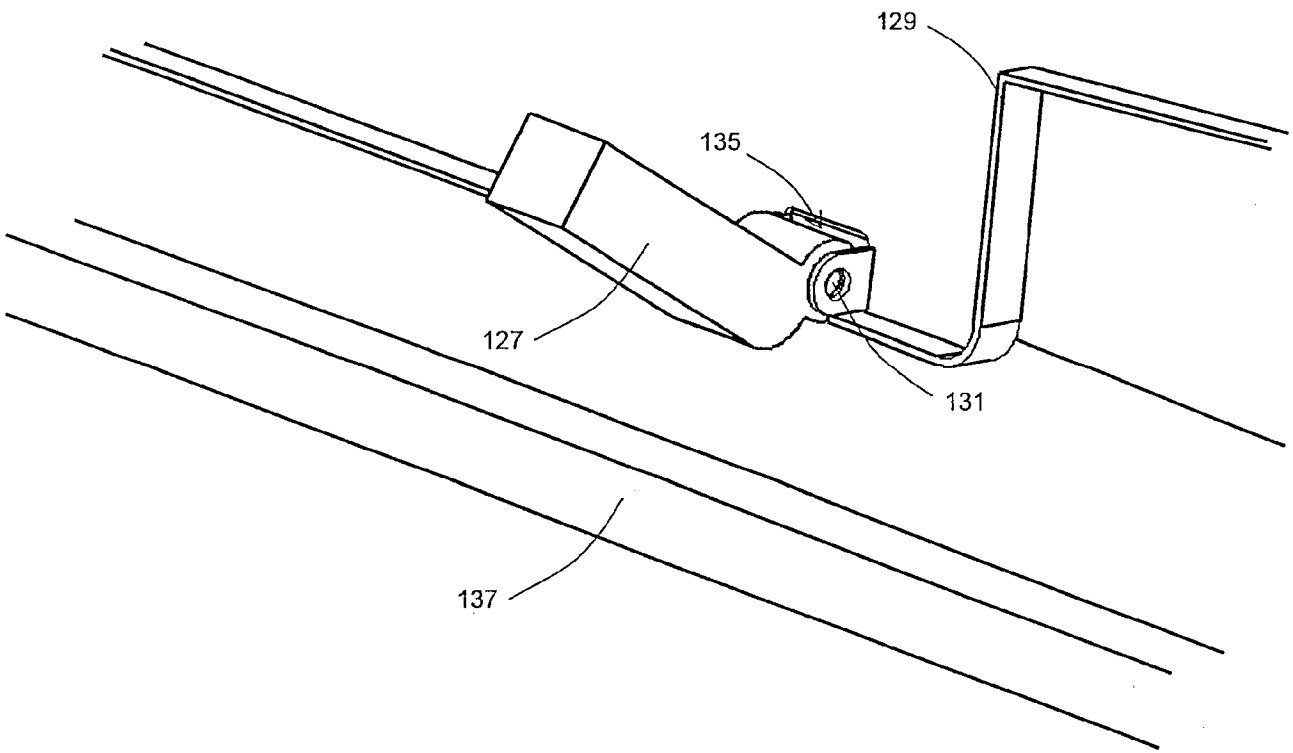
FIG. 11 is an enlarged view of a part of a stopper 127 in FIG. 10 (second embodiment)

FIG. 11 is an enlarged view of a portion of the stopper 127 in FIG. 10. As shown in FIG. 11, the stopper 127 is attached swingably along the back frame 129 around a fulcrum 131 provided at the lower end of the back frame 129 as a center. As a modification of the stopper 127 movably attached, for example, the stopper 127 may be provided so that it can slide in the vertical directions.

Figure 12:
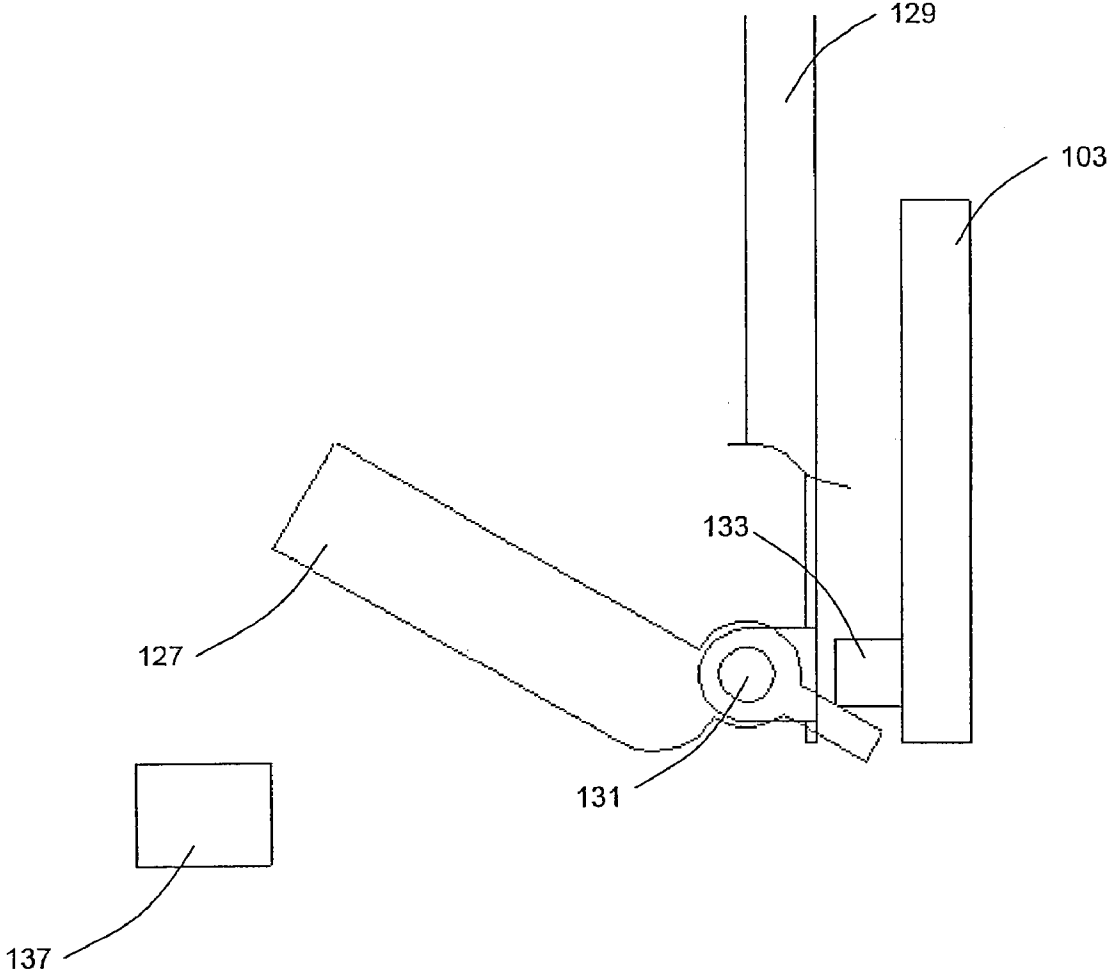
FIG. 12 is a cross section in a vertical plane orthogonal to a back frame 129 via the stopper 127 in FIG. 11 (second embodiment)

FIG. 12 is a cross section in a vertical plane passing through the stopper 127 and orthogonal to the back frame 129 in FIG. 11. In FIG. 12, one end of the stopper 127 is in contact with a link member 133 on the side opposite to the fulcrum 131 of swing with respect to the back frame 129. The link member 133 is a member attached to a frame on the back side of the second unit 103. The link member 133 is disposed so as to come into contact with the stopper 127 when the second unit 103 is pushed in the first unit 101. The other end of the stopper 127 is on the same side as that of the fulcrum 131 with respect to the back frame 129 as a reference and is at a level higher than the horizontal plane passing the fulcrum 131 for the reason that the one end is in contact with the link member 133. In a state where the second unit 103 is pulled and the link member 133 is not in contact with one end of the stopper 127, the other end of the stopper 127 is positioned at a swing end lower than the horizontal plane passing the fulcrum 131. The swing end is in a position determined by contact of one end of the stopper 127 with the upper rim of a notch 135 in the back frame 129 (refer to FIG. 13). The stopper 127 is energized by a not-shown spring and swings toward the lower swing end.

FIG. 10 shows a state where the first unit 101 is pulled out from the body and the second unit 103 is not pulled from the first unit 101. In this state, as described above, one end of the stopper 127 is in contact with the link member 133 of the second unit 103, ad the other end is positioned above then the lower swing end. When the stopper 127 is in the position, the first unit 101 can be freely pulled or pushed into the body. That is, the stopper 127 is in a release position in which the first unit 101 can be pulled or pushed.

Figure 13:
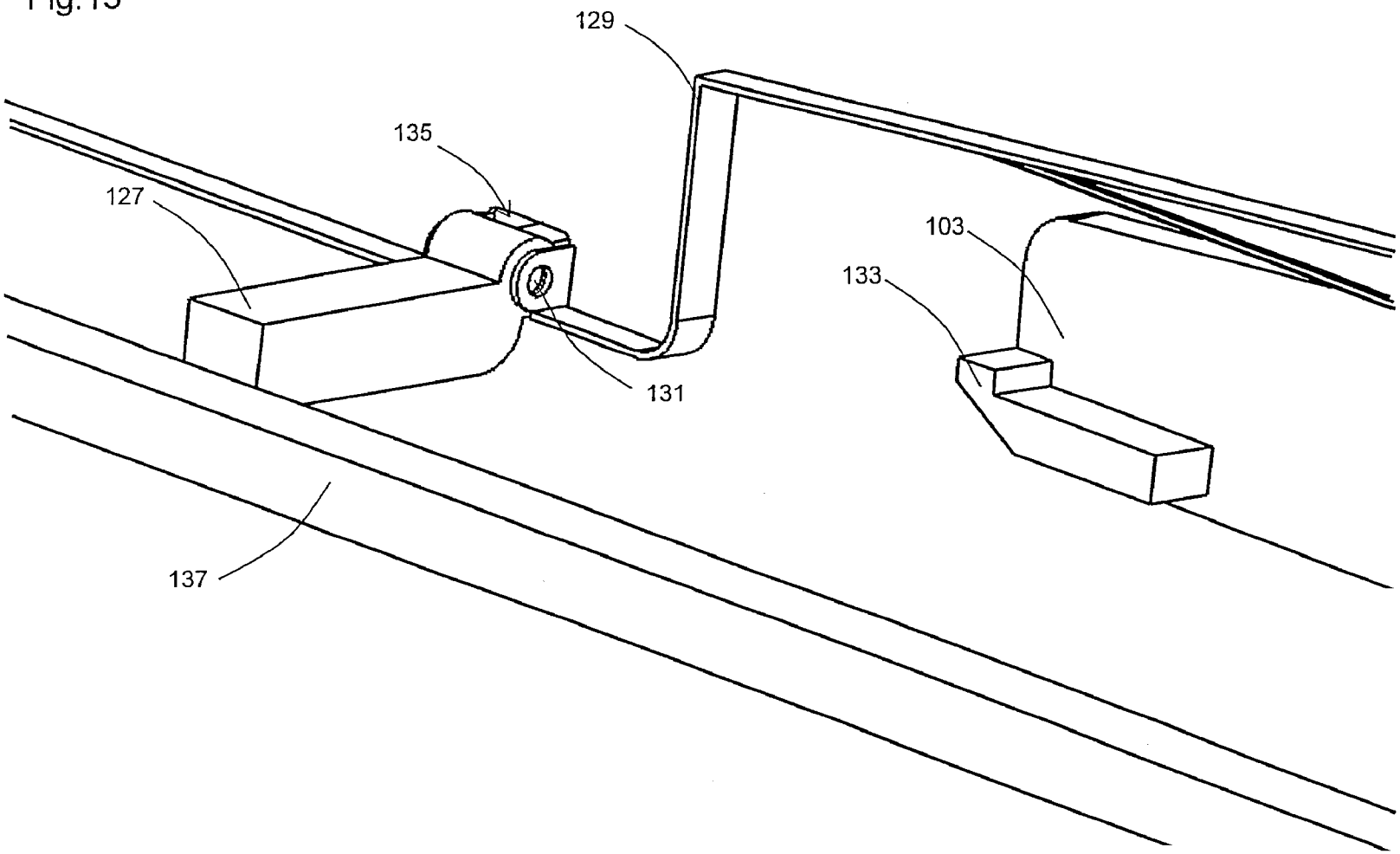
FIG. 13 is an enlarged view of a part of the stopper 127 in FIG. 1 (second embodiment)

FIG. 1 is a perspective view showing a state where the second unit 103 is pulled from the first unit 101, the contact between the stopper 127 and the link member 133 is cancelled, and the other end of the stopper 127 is positioned in the lower swing end. FIG. 13 is an enlarged view of a portion around the stopper 127 in FIG. 1. When the stopper 127 is at the lower swing end and the user tries to push the first unit 101 into the body, the other end of the stopper 127 comes into contact with a beam 137 on the front side of the body, so that the user cannot push the first unit 101.

Figure 14:
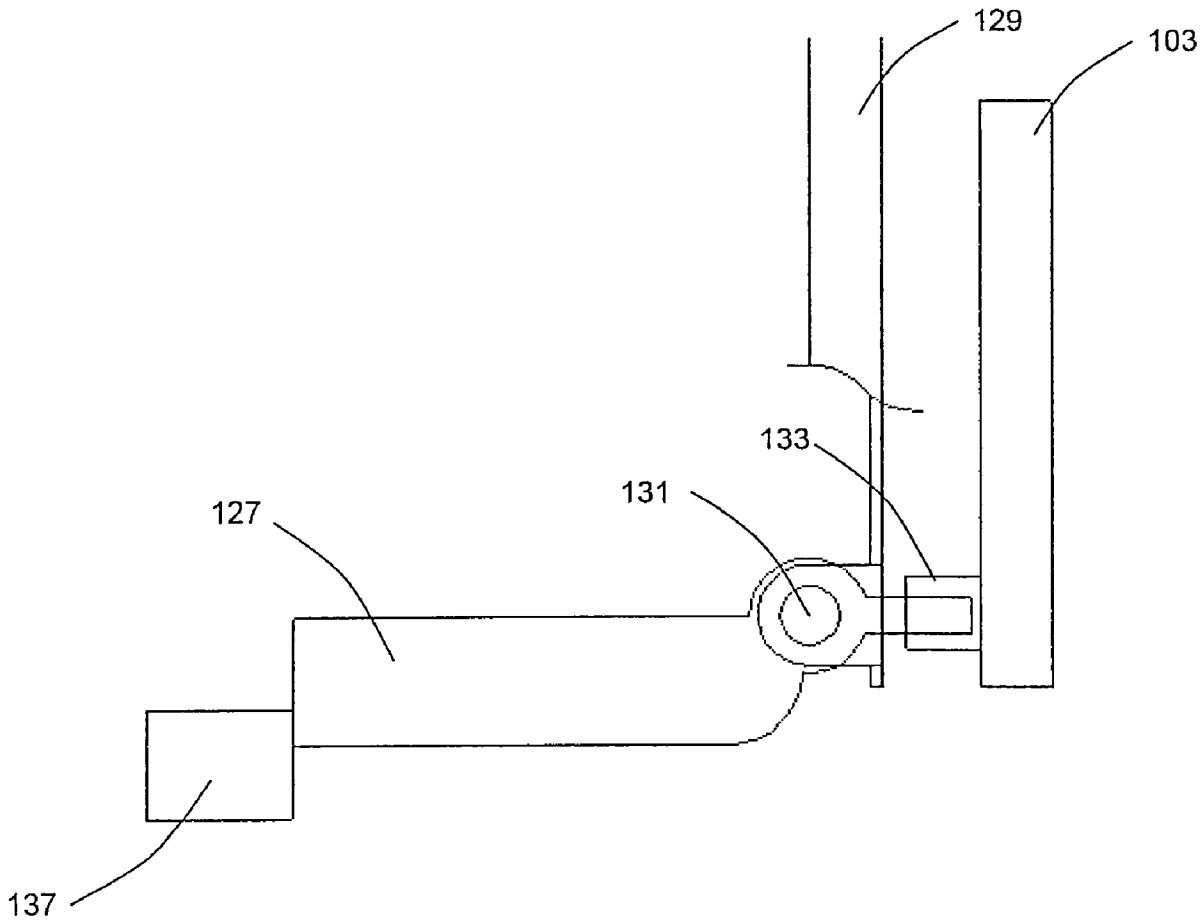
FIG. 14 is a cross section in a vertical plane orthogonal to the back frame 129 via the stopper 127 in FIG. 13 (second embodiment)

FIG. 14 is a cross section in a vertical plane passing through the stopper 127 and orthogonal to the back frame 129 in FIG. 13. As shown in FIG. 14, the other end of the stopper 127 is at the lower swing end and is in contact with the beam 137. Consequently, the first unit 101 cannot be pushed into the body further. Therefore, the second unit 103 does not collide with the body. To be specific, the stopper 127 is in a suppress position for suppressing push/pull of the first unit 101. It is sufficient to determine the position in which the link member 133 is disposed so that the contact between the stopper 127 and the beam 137 is cancelled when the second unit 103 is pushed to a position in which the second unit 103 does not come into contact with the body even when the first unit 101 is housed in the body. Preferably, a lock mechanism is provided which is locked to the first unit 101 when the second unit 103 is pushed to the predetermined position. At the time of pulling the second unit 103, the lock mechanism is unlocked. Thus, the second unit can be prevented from being pulled from the first unit when the second unit is unnecessary.

Figure 15:
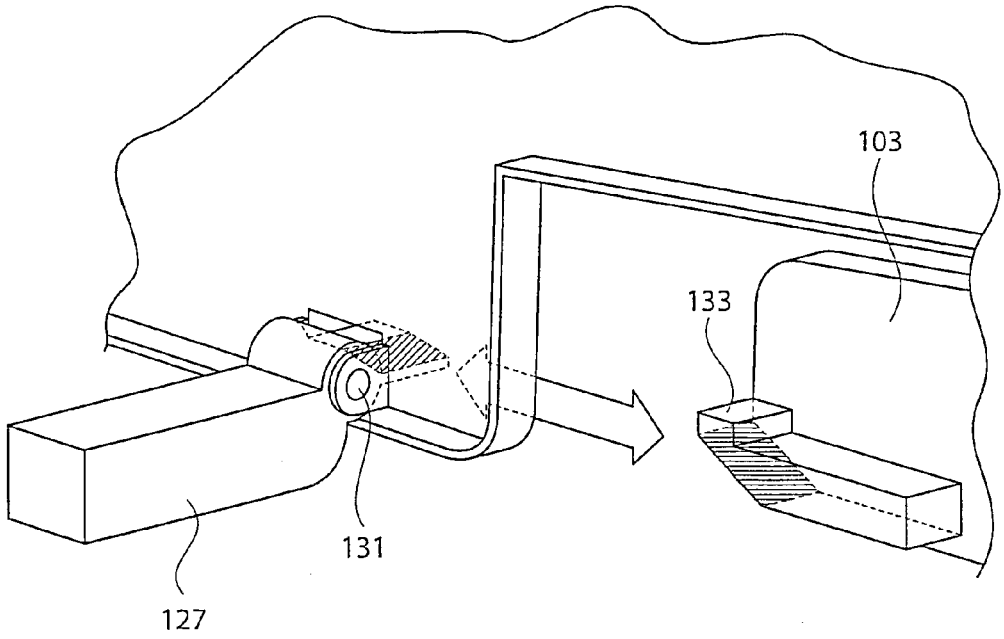
FIG. 15 is a diagram showing the shape of a link member which comes into contact with a stopper as the second unit is pulled/pushed (second embodiment)

FIG. 15 is a diagram showing the shape of the link member 133 disposed so as to come into contact with the stopper 127 in accordance with push/pull of the second unit 103. As shown in FIG. 15, the link member 133 has an oblique face in a portion which comes into contact with one end of the stopper 127. When the second unit 103 is pushed into the first unit 101 and reaches the terminating end, the oblique face of the link member 133 comes into contact with a part of the oblique face provided at one end of the corresponding stopper 127.

When the second unit 103 is further pushed from the position, the stopper 127 swings and the other end of the stopper 127 rises from the lower swing end to the position in which the other end does not come into contact with the beam 137.

Figure 16:
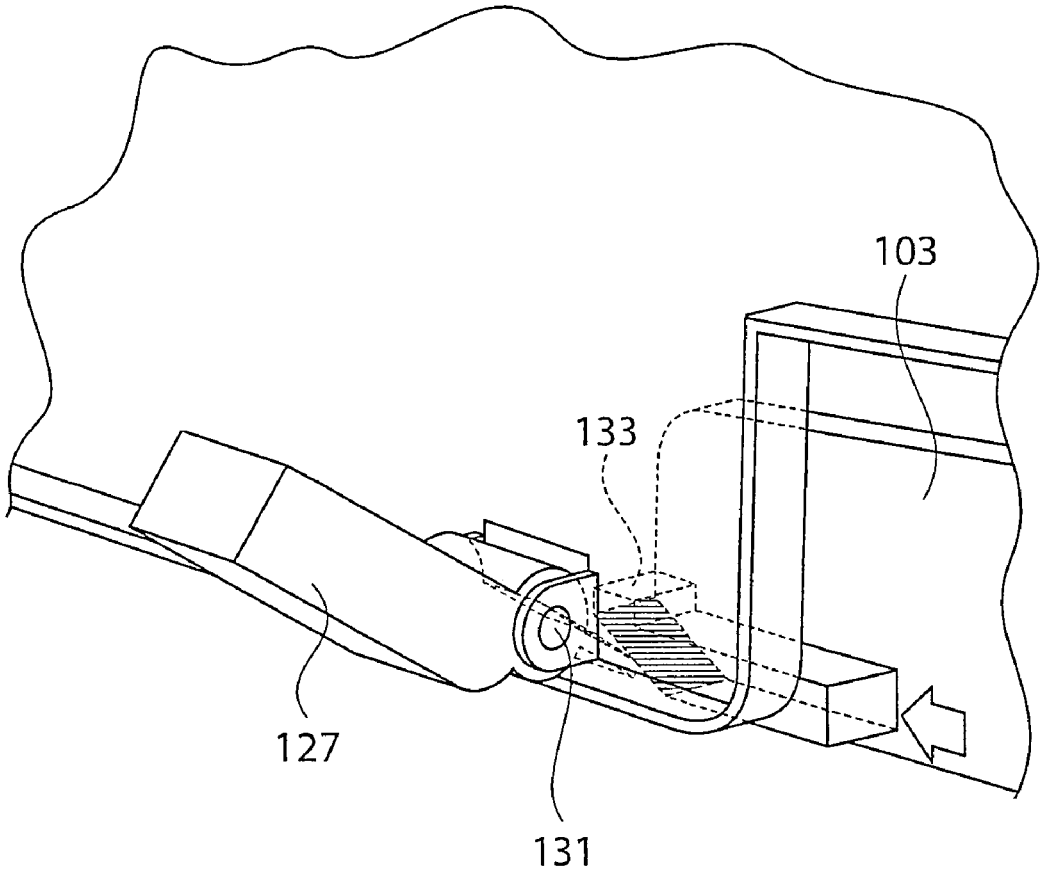
FIG. 16 is a diagram showing a state where the second unit is completely pushed and the other end of the stopper rises (second embodiment)

FIG. 16 is a diagram illustrating a state where the second unit 103 is completely pushed in and the other end of the stopper 127 rises. The position of the stopper 127 shown in FIG. 16 is the above-described release position and corresponds to the stopper positions in FIGS. 10 to 13. In this case, the user can smoothly slide the first unit 101 so that the first unit 101 is housed into the body with a small force. When the first unit 101 is pushed into the body, the other end of the stopper 127 comes into contact with a frame 139 on the back side of the body. When the first unit 101 is further pushed from the position, the stopper 127 swings against the spring force by the force applied from the frame 139 on the back side of the body, and the other end of the stopper 127 swings upward. In the position where the first unit 101 is completely pushed in the body, the other end of the stopper 127 is in a position almost perpendicular to the fulcrum 131. The first unit 101 may have a not-shown lock mechanism which is locked to the body in the position the first unit 101 is pushed in the body.

Figure 17:
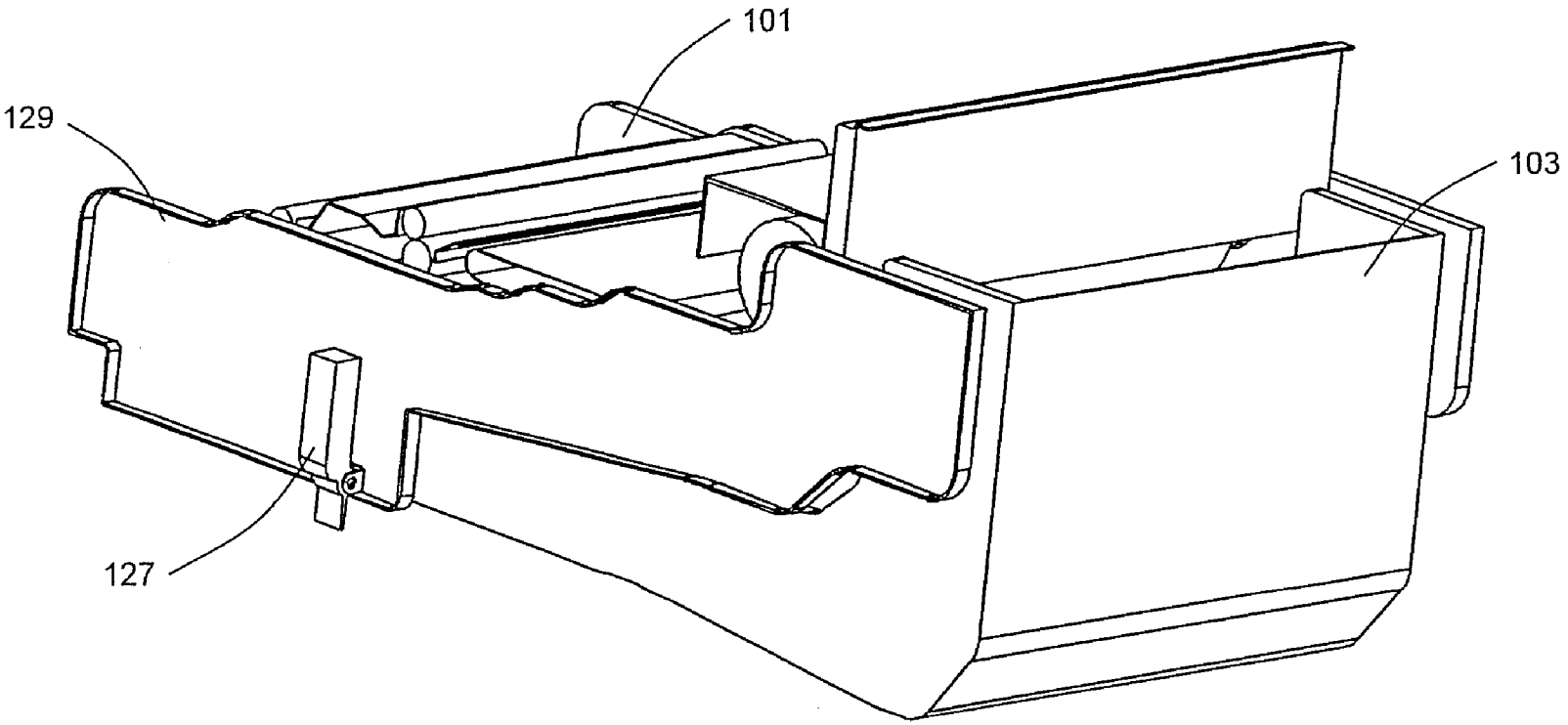
FIG. 17 is a perspective view showing a state where the first unit is housed in the body and locked (second embodiment)
Figure 18:
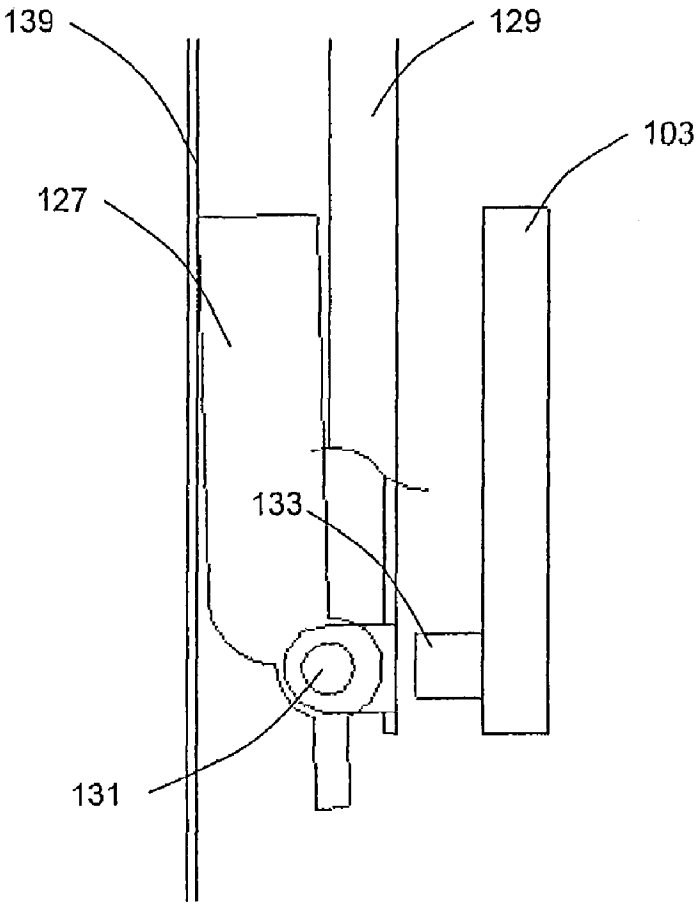
FIG. 18 is a cross section in a vertical plane orthogonal to the back frame 129 via the stopper 127 in FIG. 17 (second embodiment).

FIG. 17 is a perspective view showing a state where the first unit 101 is housed in the body. FIG. 18 is a cross section in a vertical plane passing through the stopper 127 and orthogonal to the back frame 129 in FIG. 17.

When the first unit 101 is pulled from the state of FIG. 17, the other end of the stopper 127 swings toward the lower swing end by the spring force and stops in the release position shown in FIGS. 10 and 11.

A stopper position sensor for detecting the position of the stopper 127 may be provided. When the stopper 127 is in the suppress position, the sensor may notify the user of the state by displaying it. In this case, a signal of the stopper position sensor is input to the controller, and the microcomputer detects the signal from the stopper position sensor. When the stopper 127 is in the suppress position, the microcomputer displays a message on a not-shown operation panel. To house the first unit 101 into the body, first, the microcomputer notifies the user of the fact that the second unit 103 has to be pushed. As a sensor for detecting the position of the stopper 127, for example, a reflection-type photosensor or a microswitch can be used. It is sufficient to dispose such a sensor on the back frame 129 near the stopper 127 and detect the position of the stopper 127.

Alternatively, a second unit position sensor may be provided to detect the position of the second unit 103, not the position of the stopper 127. For example, as the second unit position sensor, a microswitch or a photosensor for detecting the position of the link member 133 is disposed on the back frame 129. The sensor detects that the link member 133 is in contact with the stopper 127 and the message is displayed.

Finally, it is obvious that not only the foregoing embodiment but also various modifications of the invention are possible. It should not be interpreted that such modifications are not within the scope of the present invention. All changes that fall within meets and bounds of the claims, or equivalence of such meets and bounds are intended to be embraced by the claims of the invention.

What is claimed is:

1. An image forming apparatus comprising:

an apparatus body;

a first unit which can be pulled/pushed from/to the body along a first direction and which includes at least a part of an image forming section for forming an image and/or of a sheet transporting section for transporting a sheet onto which the formed image is transferred;

a second unit which can be pulled/pushed from/to the body along the first direction in conjunction with the first unit, and which subsequently can be pulled/pushed from/to the first unit along a second direction in a state where the first unit is pulled from the body, the second direction being different from the first direction; and a housing permitting mechanism for permitting the first unit to be pushed into the body by a predetermined operation, the housing permitting mechanism being provided for at least one of the body and the first unit.

wherein the housing permitting mechanism includes a suppressing member and a moving mechanism, the suppressing member being attached to the first unit and being able to move between a suppress position and a release position, and the moving mechanism being provided for moving the suppressing member to the suppress position when the second unit is pulled from the first unit more than the predetermined position, the suppress position is a position in which the suppressing member comes into contact with the body, the release position is a position in which the suppressing member does not come into contact with the body, the moving mechanism comprises a link member and an energizing member, the link member being supported by the second unit and can come into contact with the suppressing member, the energizing member being provided for energizing the suppressing member toward the suppress position, the link member comes into contact with the suppressing member to move the suppressing member to the release position when the second unit is pushed to a predetermined position in the first unit, and the link member is apart from the suppressing member to permit the suppressing member to move to the suppress position when the second unit is pulled more than the predetermined position.

2. The image forming apparatus according to claim 1, further comprising:

a rail fixed to the body and extending in the first direction; and a moving member fixed to the first unit and moving along the rail, wherein the housing permitting mechanism is a press section using an elastic member, being disposed in one or more places in the rail and pressing the moving member with elasticity of the elastic member when the moving member passes, and the predetermined operation is an operation of pushing the first unit against a press force of the press section.

3. The image forming apparatus according to claim 1, wherein the predetermined operation is an operation of pushing the second unit pulled from the first unit to a predetermined position in the first unit, and the housing permitting mechanism is a mechanism of suppressing housing of the first unit into the body when the second unit is pulled from the first unit more than the predetermined position.

4. The image forming apparatus according to claim 1, wherein the link member moves the suppressing member to the release position when the second unit is pushed to a position in which contact between the second unit and the body is avoided even if the first unit is housed in the body.

5. The image forming apparatus according to claim 1, further comprising:

a suppressing member position detector for detecting that the suppressing member is in the suppress position; and a notifying section for notifying of the fact that housing of the first unit to the body is suppressed when the suppressing member is in the suppress position on the basis of detection of the suppressing member position detector.

6. The image forming apparatus according to claim 1, further comprising:

a second unit position detector for detecting that the second unit is in the predetermined position; and a notifying section for notifying of the fact that housing of the first unit to the body is suppressed when the second unit is in a position other than the predetermined position on the basis of detection of the second unit position detector.

* * * * *